US012168882B2

(12) United States Patent
Müller et al.

(10) Patent No.: US 12,168,882 B2
(45) Date of Patent: Dec. 17, 2024

(54) CONCRETE-PUMP BOOM-ARM SEGMENT HAVING A VARIABLE SHEET-METAL THICKNESS IN THE LONGITUDINAL DIRECTION, AND METHOD FOR PRODUCING SUCH A CONCRETE-PUMP BOOM-ARM SEGMENT

(71) Applicant: Putzmeister Engineering GmbH, Aichtal (DE)

(72) Inventors: Ansgar Müller, Stuttgart (DE); Roland Maassen, Munich (DE)

(73) Assignee: Putzmeister Engineering GmbH, Aichtal (DE)

( * ) Notice: Subject to any disclaimer, the term of this patent is extended or adjusted under 35 U.S.C. 154(b) by 1217 days.

(21) Appl. No.: 16/956,055

(22) PCT Filed: Dec. 18, 2018

(86) PCT No.: PCT/EP2018/085418

§ 371 (c)(1),
(2) Date: Jun. 19, 2020

(87) PCT Pub. No.: WO2019/121632

PCT Pub. Date: Jun. 27, 2019

(65) Prior Publication Data

US 2020/0370314 A1 Nov. 26, 2020

(30) Foreign Application Priority Data

Dec. 19, 2017 (DE) ..... 10 2017 223 240.4

(51) Int. Cl.
*E04G 21/04* (2006.01)

(52) U.S. Cl.
CPC ..... *E04G 21/0445* (2013.01); *E04G 21/0436* (2013.01); *Y10T 137/8807* (2015.04)

(58) Field of Classification Search
CPC ..... E04G 21/0418; E04G 21/0427; E04G 21/0436; E04G 21/0445; E04G 21/0454;
(Continued)

(56) References Cited

U.S. PATENT DOCUMENTS 3,707,990 A * 1/1973 Schaible ..... E04G 21/0436 137/615
3,942,554 A 3/1976 Werner et al.
4,105,151 A * 8/1978 Eltzroth ..... E02F 3/38 228/119

(Continued)

FOREIGN PATENT DOCUMENTS

CN 201330507 Y 10/2009
JP S6165087 U 5/1986

(Continued)

OTHER PUBLICATIONS

International Search Report English Translation for International application No. PCT/EP2018/085418 dated Mar. 4, 2019; 2 pgs.

(Continued)

*Primary Examiner* — Kenneth Rinehart
*Assistant Examiner* — Jonathan J Waddy
(74) *Attorney, Agent, or Firm* — Alix, Yale & Ristas, LLP

(57) ABSTRACT

The invention related to a concrete-pump boom-arm segment having an upper chord (33), a lower chord (34) and two lateral parts (35, 36) which connect the upper chord (33) and the lower chord (34). The boom-arm segment comprises a longitudinal connection (44) between two subregions (41, 42) of the boom-arm segment which adjoin one another in the longitudinal direction, wherein the longitudinal connection (44) extends over a chord portion (56, 66) and over a lateral part portion (53, 63). The lateral part portion (53, 63) is bent over with respect to the chord portion (56, 66) in the first subregion (41) and in the second subregion (42). The material thickness of the chord portion (56) is greater in the (Continued)

first subregion (41) than the material thickness of the chord portion (66) in the second subregion (42). The invention additionally relates to a method for producing such a boom-arm segment. Such a boom-arm segment is well suited for absorbing static and dynamic loads and can be produced in a cost-effective manner.

12 Claims, 5 Drawing Sheets

(58) Field of Classification Search
CPC ..... E04G 21/0463; B66C 23/66; B66C 23/70; Y10T 137/8807
USPC ..... 137/615; 138/151–153, 155–176; 212/347; 248/70; 285/189–222
See application file for complete search history.

(56) References Cited

U.S. PATENT DOCUMENTS 5,351,716 A * 10/1994 Korthaus ..... E04G 21/0436 138/30
6,493,921 B1 * 12/2002 Tarkington ..... B65G 63/022 104/126
6,691,487 B2 * 2/2004 Daudet ..... E04C 3/09 52/220.8
2003/0126772 A1 * 7/2003 Masumoto ..... E02F 3/38 212/347
2004/0161326 A1 * 8/2004 Yamaguchi ..... E02F 3/38 414/722
2008/0187427 A1 8/2008 Durney
2013/0020274 A1 1/2013 Munuswamy et al.

FOREIGN PATENT DOCUMENTS

JP 2004124357 A 4/2004
JP 2005029984 A * 2/2005

OTHER PUBLICATIONS

PCT International Preliminary Report on Patentability dated Jun. 23, 2020 and Written Opinion for International Application No. PCT/EP2018/085418 filed Dec. 18, 2018; 7 pgs.

* cited by examiner

CONCRETE-PUMP BOOM-ARM SEGMENT HAVING A VARIABLE SHEET-METAL THICKNESS IN THE LONGITUDINAL DIRECTION, AND METHOD FOR PRODUCING SUCH A CONCRETE-PUMP BOOM-ARM SEGMENT

BACKGROUND

The invention relates to a concrete-pump boom-arm segment having an upper chord, a lower chord and two side parts, which connect the upper chord and the lower chord. The invention furthermore relates to a method for producing a concrete-pump boom-arm segment of this kind.

Concrete-pump boom arms are used, for example, to guide a delivery line connected to a concrete pump in such a way that the liquid concrete delivered by the concrete pump can be discharged in a region remote from the concrete pump. A concrete-pump boom arm of this kind is generally assembled from a plurality of boom-arm segments, wherein, in an unfolded state, the boom-arm segments together make up the length of the boom arm and wherein, in a folded state, the boom-arm segments are folded up into a compact state in order to make transportation easier.

Since concrete pumps are normally designed in such a way that the liquid concrete is delivered in pulses, the boom arms are subject to considerable dynamic loads. In addition, there is the fact that the boom-arm segments can be folded in different ways when the concrete pump is in operation, depending on the distance from the concrete pump at which the liquid concrete is to be discharged. This has the effect that the tensile and compressive loads on a boom-arm segment act in completely different directions, depending on the operating state of the boom arm. For these reasons, boom-arm segments of a concrete pump are subject to special loads in operation.

SUMMARY OF THE INVENTION

It is the underlying object of the invention to present a concrete-pump boom-arm segment and a method for producing a concrete-pump boom-arm segment such that the concrete-pump boom-arm segment easily withstands static and dynamic loads and is inexpensive to produce. Proceeding from the cited prior art, the object is achieved by means of the features of the independent claims. Advantageous embodiments are specified in the dependent claims.

The concrete-pump boom-arm segment according to the invention comprises a longitudinal joint between two subregions of the boom-arm segment which adjoin one another in the longitudinal direction. The longitudinal joint extends over a chord portion and over a side-part portion. In the first subregion and in the second subregion, the side-part portion is bent over with respect to the chord portion. The material thickness of the chord portion in the first subregion is greater than in the second subregion.

The invention is recognized that a longitudinal joint of this kind is well-suited to absorbing the static and dynamic forces which occur in the concrete-pump boom-arm segment. Since the side-part portion is bent over with respect to the chord portion, increased local stability is obtained in comparison with a traditional concrete-pump boom-arm segment, in which a weld seam is formed between the chord and the side part. If a higher load can be absorbed in the region of the edges, a reduced material thickness in the upper chord and/or lower chord can be accepted in certain subregions of the boom-arm segment. The longitudinal joint according to the invention is used to connect the regions of different material thickness to one another.

The longitudinal joint can be designed as a weld seam. By means of the weld seam, a component of the first subregion and a component of the second subregion can be butt welded to one another. The material thickness in the first subregion can be between 2 mm and 15 mm, preferably between 3 mm and 10 mm, for example. The material thickness in the second subregion can be less than the material thickness in the first subregion by a value of between 0.5 mm and 4 mm, preferably between 1 mm and 3 mm. The material thickness specifications according to the invention relate to regions outside the weld seam.

The upper chord, the lower chord and the two side parts can form a concrete-pump boom-arm segment of box-shaped cross section. In this case, the side parts of the box-shaped profile can be arranged in a plane parallel to the force of gravity. If the upper chord and the lower chord are arranged substantially at right angles to the side parts, this means that the force of gravity acts transversely to the plane of the upper chord and of the lower chord when the longitudinal axis of the boom-arm segment is pointing in a lateral direction, as intended. The upper chord and the lower chord of the boom-arm segment are then subject to a large bending load. The terms upper chord and lower chord should not be interpreted as indicating the position of the upper chord and lower chord relative to one another. On the contrary, whether the upper chord is positioned above or below the lower chord depends on the operating state of the boom-arm segment. Both are possible in the context of the invention. The concrete-pump boom-arm segment can comprise a pivot for pivotable connection to an adjacent concrete-pump boom-arm segment. The pivot can be aligned in such a way that it intersects the side parts of the concrete-pump boom-arm segment.

With the chord portion and the side-part portion, the longitudinal joint according to the invention extends over portions of two surfaces of the boom-arm segment, namely over a portion of a chord surface and over a portion of a lateral surface. The chord surface and the lateral surface can enclose an angle of between 60° and 120°, preferably between 80° and 100°, as a further preference about 90°, when considered in a cross section of the boom-arm segment. The angle formed by the bend between the chord portion and the side-part portion can be of a corresponding size.

In the first subregion, the material thickness in the chord portion can coincide with the material thickness in the side-part portion. The same can apply to the second subregion.

The chord portion can extend in one plane in the first subregion adjoining the longitudinal joint. The side-part portion can likewise extend in one plane in the first subregion adjoining the longitudinal joint. If both the chord portion and the side-part portion have a flat shape, the bending over between the two is made easier. In a corresponding manner, the chord portion and/or the side-part portion can extend in one plane in the second subregion adjoining the longitudinal joint from the other side. The chord portions in the first subregion and in the second subregion can extend in the same plane. The side-part portions in the first subregion and in the second subregion can extend in the same plane.

The longitudinal joint according to the invention can extend over the entire width of the chord surface. The longitudinal joint can furthermore extend over two side-part portions, wherein one side-part portion joins the chord portion on one side, and the second side-part portion joins the chord portion on the other side. The boom-arm segment can have a symmetrical shape in relation to a longitudinal axis in the region of the longitudinal joint. The longitudinal joint can be aligned in the transverse direction, with the result that the longitudinal direction is intersected at an angle of 90°.

In the first subregion, the chord portion can extend without a weld seam between the two side-part portions. It is thus possible to move across the chord portion parallel to the longitudinal joint without intersecting a weld seam.

A longitudinal joint having corresponding features can be formed in the opposite chord surface. The longitudinal joints in the two chord surfaces can be aligned in such a way relative to one another that a plane extending through the longitudinal joints intersects the longitudinal axis of the boom-arm segment at a right angle.

The side-part portion adjoining the longitudinal joint can be welded to a further component of the boom-arm segment. The joint can be a weld seam. The weld seam can extend in the longitudinal direction of the boom-arm segment. The side-part portion can be butt-joined to the further component. These features can apply to the first and/or the second subregion of the boom-arm segment.

The further component can be a side-part portion which is bent over from the opposite chord surface. A movement parallel to the longitudinal joint from one chord surface to the other chord surface does not intersect any further weld seam apart from the weld seam between the two side-part portions. The two side-part portions which are joined together by the weld seam aligned in the longitudinal direction can have a corresponding material thickness. These features can apply to the first and/or the second subregion of the boom-arm segment.

In an alternative embodiment, the further component adjoining the bent-over side-part portion is a side plate. The side plate can extend in the plane of the side part. The side plate can be joined to the bent-over side-part portion by a weld seam. The side plate can be butt jointed to the bent-over side-part portion. The side plate can have a lower material thickness than the bent-over side-part portion. The material thickness of the side plate can be between 30% and 70%, preferably between 40% and 60%, of the material thickness of the bent-over side-part portion, for example.

On one side, the side plate can be connected to a side-part portion which is bent over with respect to the upper chord and, on the other side, can be connected to a side-part portion which is bent over with respect to the lower chord. A movement parallel to the longitudinal joint from one chord surface to the other chord surface does not intersect any further weld seam apart from the two weld seams of the side plate.

The features described for the side plate can apply to a side plate of the first subregion of the concrete-pump boom-arm segment and/or to a side plate of the second subregion of the concrete-pump boom-arm segment. A side plate of the first subregion of the boom-arm segment can adjoin a side plate of the second subregion of the boom-arm segment in the longitudinal direction. The longitudinal joint can extend over the joint between the two side plates. The two side plates can be butt welded to one another. The longitudinal joint between the side plates can be aligned in such a way with respect to the longitudinal joint in the upper chord and/or with respect to the longitudinal joint in the lower chord that a plane which extends through the longitudinal joints intersects the longitudinal axis of the boom-arm segment at a right angle.

The boom-arm segment can comprise a first side plate and a second side plate, with the result that the first side plate forms a portion of one side part and the second side plate forms a portion of the opposite side part. This can apply to the first and/or the second subregion of the boom-arm segment. In this way, a box-shaped profile can be assembled from four components, namely from two chord components with bent-over side-part portions and from two side plates.

In the box-shaped profile, the side parts can be aligned parallel to one another and/or the chord surfaces can be aligned parallel to one another when viewed in a section perpendicular to the longitudinal axis of the boom-arm segment.

The boom-arm segment can taper from the first subregion in the direction of the second subregion. Thus, in the first subregion, the distance between opposite surfaces of the box-shaped profile decreases as the longitudinal joint is approached. In the second subregion, the distance between opposite surfaces of the box-shaped profile decreases in a direction away from the longitudinal joint. The taper can refer to the distance between the two lateral surfaces and/or to the distance between the upper chord and the lower chord.

The first subregion can be arranged closer to a proximal end, and the second subregion closer to a distal end, of the boom-arm segment. "Proximal" refers to an end of the boom-arm segment which, in the unfolded state of the boom arm, is closer to the base (that is to say the truck, for example) on which the boom arm is mounted. Conversely, the distal end of the boom-arm segment is closer to the free end of the boom arm in the unfolded state.

It is possible for one or more beads, by means of which the profile of the concrete-pump boom-arm segment according to the invention is reinforced, to be formed in the side part, the upper chord and/or the lower chord respectively. The beads can extend in the longitudinal direction of the boom-arm segment. If an individual bead is formed in one surface, the bead can be arranged centrally between two edges delimiting the surface. Narrow beads that extend over 5% to 20% of the width of the surface are possible. Wide beads that extend over 20% to 60% of the width of the surface are also possible. The beads can be curved inward or outward relative to the surface.

The boom-arm segment can comprise a reinforcing plate which extends across the longitudinal joint. The reinforcing plate can rest flat on other components of the boom-arm segment. The reinforcing plate can be joined to other components of the boom-arm segment in the first subregion and in the second subregion. The joint can comprise a weld seam which can extend along a peripheral line of the reinforcing plate. In particular, the reinforcing plate can be welded over its entire periphery to other components of the boom-arm segment. The reinforcing plate can overlap with the bent-over side-part portion.

Each reinforcing plate can be provided in duplicate, wherein the two reinforcing plates can be arranged symmetrically with respect to one another, relative to a vertical longitudinal section through the boom-arm segment. In total, the boom-arm segment can comprise four reinforcing plates, which extend across the same longitudinal joint. In particular, two reinforcing plates can overlap with the side-part portions that are bent over with respect to the upper chord, and two reinforcing plates can overlap with the side-part portions which are bent over with respect to the lower chord.

The reinforcing plate can be configured in such a way that it tapers with increasing distance from the longitudinal joint. This can apply to the first subregion and/or the second subregion of the boom-arm segment. The taper can refer to the extent of the surface and/or to the thickness of the reinforcing plate. By means of such a taper, it is possible to ensure that the stresses in the components adjoining the longitudinal joint decrease continuously with increasing distance from the longitudinal joint. The reinforcing plate thus promotes uniform transfer of the forces between the first subregion and the second subregion of the boom-arm segment.

In addition or as an alternative thereto, the reinforcing plate overlapping with the side-part portion can be shaped and arranged in such a way that the reinforcing plate is arranged close to one edge of a chord portion in the region of the longitudinal joint and that the distance from the edge increases with increasing distance from the longitudinal joint. This can apply to the first subregion and/or the second subregion of the boom-arm segment. By means of this configuration of the reinforcing plate too, the uniform transfer of forces between the subregions of the boom-arm segment can be promoted.

The reinforcing plate in its entirety can overlap with the side part. It is also possible for the reinforcing plate to project upward or downward beyond the side part. The highest and lowest point in this portion of the boom-arm segment is then not formed by the upper chord or lower chord but by that portion of the reinforcing plate which projects beyond said chords. A reinforcing plate which extends over the entire width of the upper chord and lower chord and overlaps with two opposite side parts in the manner of a sleeve is also possible.

The reinforcing plate can overlap with a bead formed in a side part. The bead can project outward relative to the surface of the side part. The reinforcing plate can end on a sloping surface of the bead. In this variant, it is advantageous if the thickness of the reinforcing plate does not exceed the thickness of the bead, ensuring that the reinforcing plate does not project further than the bead in the lateral direction.

It is also possible for the reinforcing plate to overlap with a surface of the bead which is aligned parallel to the side part. In this case, the reinforcing plate can have a greater thickness than the bead, with the result that the reinforcing plate projects further to the side than the bead. In the region of the bead, the reinforcing plate can have a recess matched to the bead, with the result that the reinforcing plate does not project further outward in the region of the bead.

The invention also includes variants in which the upper chord and/or the lower chord are/is fitted with one or more reinforcing plates. These reinforcing plates can have the same features that have been described in the context of reinforcing plates arranged on the side part.

The concrete-pump boom-arm segment according to the invention can be fitted with a respective pivot joint element at its proximal end and at its distal end. The pivot joint element can be designed to form, with a matching pivot joint element of an adjacent boom-arm segment or a base, a pivot joint by means of which the boom-arm segment can be pivoted relative to the other part.

The boom-arm segment can comprise an articulation point for a hydraulic cylinder which extends in the direction of the distal end of the boom-arm segment, starting from the articulation point. The longitudinal joint according to the invention can be arranged between the proximal end of the boom-arm segment and the articulation point. The boom-arm segment can comprise a plurality of such longitudinal joints, in particular at least three such longitudinal joints, preferably at least four such longitudinal joints, which are arranged between the proximal end of the boom-arm segment and the articulation point. The material thickness can decrease successively with increasing distance from the proximal end. Between two longitudinal joints, the material thickness can be constant. This can apply to the upper chord, the lower chord and/or the side parts.

The invention furthermore relates to a concrete-pump boom arm having a plurality of boom-arm segments, wherein at least one of the boom-arm segments comprises a longitudinal joint according to the invention. A pivot joint is formed between each two adjacent boom-arm segments. The axis of the pivot joint can be aligned in such a way that it extends through both side parts of the boom-arm segment, wherein the two side parts are preferably intersected at right angles or enclose an angle of less than 10°, preferably less than 5°, with this direction. The chord surfaces can extend parallel to the pivot.

The joint can comprise a first articulated lever, which is attached pivotably to a first boom-arm segment. The joint can comprise a second articulated lever, which is attached pivotably to the second boom-arm segment and which is furthermore attached pivotably to the first articulated lever. A hydraulic cylinder can extend from the first boom-arm segment to the first articulated lever, with the result that a stroke motion of the hydraulic cylinder is converted into a pivoting motion between the boom-arm segments. As viewed from the first boom-arm segment, the hydraulic cylinder is preferably attached to the first articulated lever on the far side of the second articulated lever.

The concrete-pump boom arm can comprise a delivery line for slurry, in particular fresh concrete, which extends along the boom arm. Each segment of the boom arm can be assigned a segment of the delivery line. Adjacent segments of the delivery line can be connected to one another via a joint, wherein the joint axis is preferably coaxial with the joint by means of which the associated boom-arm segments are connected to one another. The individual segment of the delivery line can be designed as a rigid pipe.

The invention furthermore relates to a method for producing a concrete-pump boom-arm segment, wherein the boom-arm segment comprises an upper chord, a lower chord and two side parts, which connect the upper chord and the lower chord. In the method, a longitudinal joint is produced between a first subregion of the boom-arm segment and a second subregion of the boom-arm segment, which joint extends over a chord portion and over a side-part portion. The side-part portion is bent over with respect to the chord portion in the first subregion and in the second subregion. The material thickness of the chord portion is greater in the first subregion than in the second subregion.

The longitudinal joint can be produced by welding. It is possible first of all to produce the longitudinal joint between a component of the first subregion and a component of the second subregion and then to bend the side-part portion over with respect to the chord portion. Alternatively, it is possible first of all for the side-part portion on two components that are still separate to be bent over with respect to the chord portion and then for the longitudinal joint to be produced.

The method can be refined by means of further features, which are described in conjunction with the boom-arm segment according to the invention. The boom-arm segment can be refined by means of further features which are described in conjunction with the method according to the invention.

BRIEF DESCRIPTION OF THE DRAWINGS

The invention is described by way of example below by means of advantageous embodiments with reference to the attached drawings. In the drawings.

DETAILED DESCRIPTION

Figure 1:
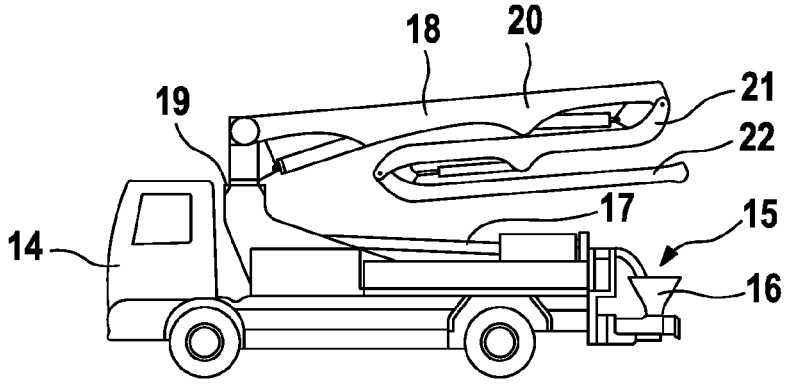
FIG. 1: shows a concrete-pump vehicle having a boom arm in the folded state.
Figure 2:
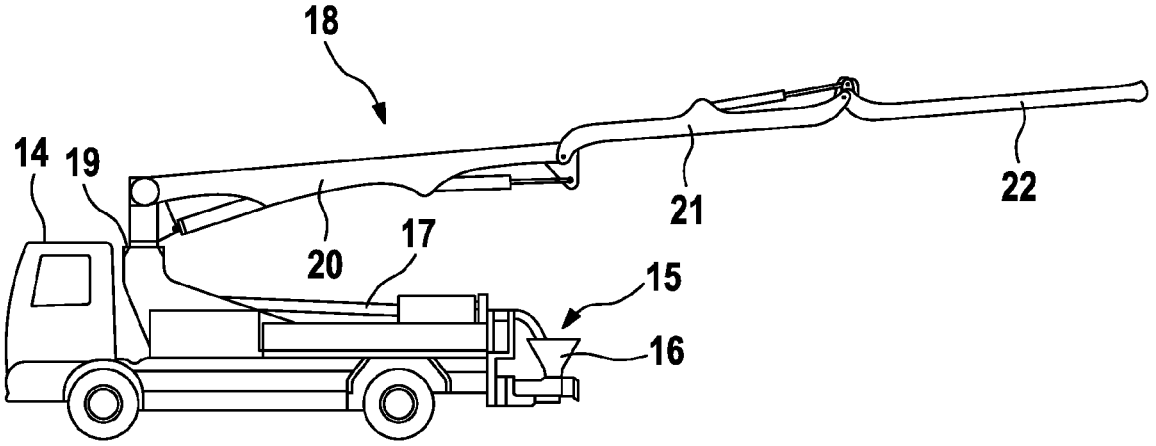
FIG. 2: shows the concrete-pump vehicle from FIG. 1 with the boom arm unfolded.

A truck 14 shown in FIG. 1 is equipped with a concrete pump 15, which delivers liquid concrete from a pre-charging tank 16 via a delivery line 17. The delivery line 17 extends along a boom arm 18, which is rotatably mounted on a slewing ring 19. The boom arm 18 comprises three boom-arm segments 20, 21, 22, which are connected to one another in articulated fashion. Since the boom-arm segments 20, 21, 22 can be pivoted relative to one another by means of the joints, the boom arm 18 can change between a folded state (FIG. 1) and an unfolded state (FIG. 2). The delivery line 17 extends beyond the distal end of the third boom-arm segment 22, thus enabling the liquid concrete to be discharged in a region remote from the concrete pump 15.

Depending on the pivoted state of the boom arm, the loads on the boom-arm segments 20, 21, 22 act in completely different directions. Moreover, the boom arm is exposed to high dynamic loads by the pulsed delivery of the liquid concrete.

The pivot joints between the boom-arm segments 20, 21, 22 are configured in such a way that they allow a large pivoting angle. In the folded state, the boom-arm segments 20, 21, 22 are substantially parallel to one another and enclose a small angle between them. In the unfolded state shown in FIG. 2, the boom-arm segments 20, 21, 22 form extensions of one another.

Figure 4:
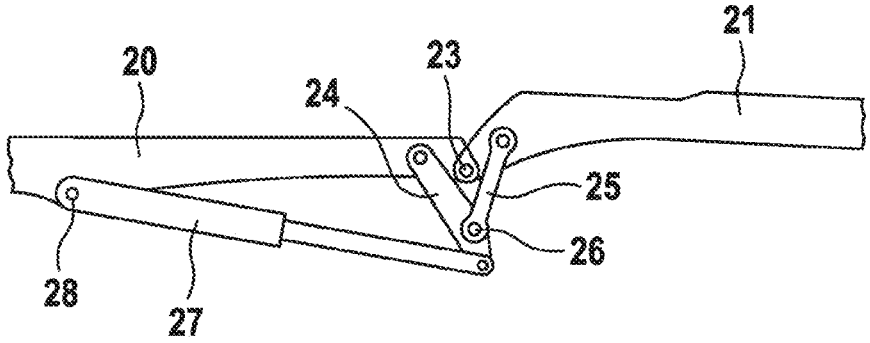
FIG. 4: shows a joint between two boom-arm segments.

The joint design is illustrated in FIG. 4 using the example of the pivot joint between the first boom-arm segment 20 and the second boom-arm segment 21. The pivot is formed by a pivot pin 23, by means of which a proximal end of the boom-arm segment 21 is connected to a distal end of the boom-arm segment 20. A first articulated lever 24 is attached to the first boom-arm segment 20 at a point adjacent to the pivot pin 23. A second articulated lever 25 is attached to the second boom-arm segment 21 at a point adjacent to the pivot pin 23. The two articulated levers are connected to one another in articulated fashion at 26. A hydraulic cylinder 27 extends from an articulation point 28 on the first boom-arm segment 20 to the outer end of the first articulated lever 24. By means of the articulated levers 24, 25, a stroke motion of the hydraulic cylinder 27 is converted into a pivoting motion between the boom-arm segments 20, 21.

Figure 3:
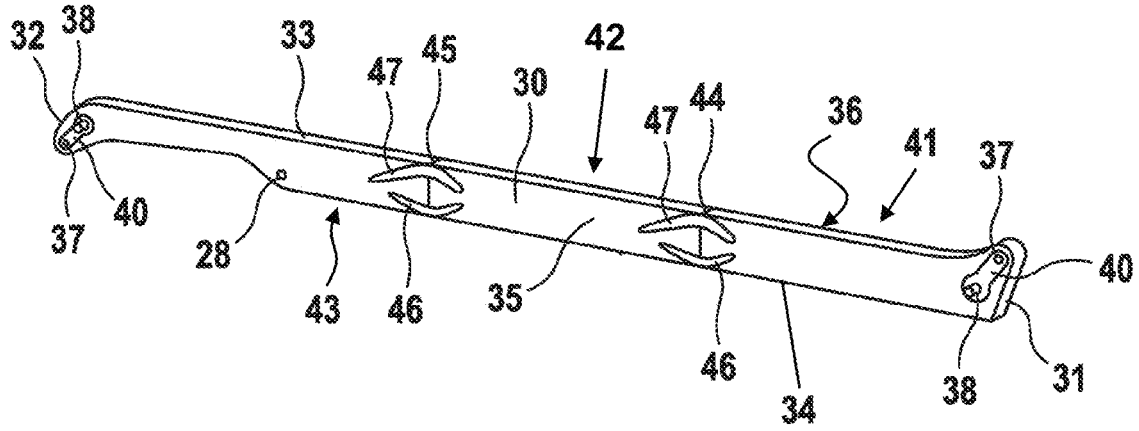
FIG. 3: shows a boom-arm segment according to the invention.

A boom-arm segment 30 according to the invention, which is shown in FIG. 3, extends from a proximal end 31 to a distal end 32. The boom-arm segment 30 is designed as a box-shaped profile with an upper chord 33, a lower chord 34 and two side parts 35, 36. A pivot hole 37 is formed close to the proximal end 31. The pivot hole accommodates the pivot pin 23, which connects the boom-arm segment 30 to an adjacent boom-arm segment.

Arranged next to the pivot hole 37 is a stud bolt 38, to which the articulated lever 25 is connected. A reinforcing plate 40 surrounds the pivot hole 37 and the stud bolt 38, thus enabling the particularly high forces which occur in this region to be reliably absorbed. In corresponding fashion, the boom-arm segment 30 comprises, close to its distal end, a further pivot hole 37 and a further stud bolt 38, to which an articulated lever 24 can be connected. A reinforcing plate 40 surrounds the pivot hole 37 and the stud bolt 38. Corresponding reinforcing plates 40 are formed on the opposite side part 36 of the boom-arm segment 30, which is not visible in FIG. 3.

The box-shaped profile of the boom-arm segment tapers continuously from the proximal end 31 to the articulation point 28 for the hydraulic cylinder. The two side parts 35, 36 as well as the upper chord 33 and the lower chord 34 thus each approach one another as the distance from the proximal end 31 increases. The taper is still quite clear in the region of the pivot hole 37 and the continuous taper then continues to a reduced extent, such that the change in cross-section is virtually imperceptible in FIG. 3.

Between the proximal end 31 and the articulation point 28, the boom-arm segment comprises two longitudinal joints 44, 45. Longitudinal joint 44 is arranged between a first subregion 41 and a second subregion 42 of the boom-arm segment, while longitudinal joint 45 is arranged between the second subregion 42 and a third subregion 43 of the boom-arm segment. The upper chord 33 and the lower chord 34 have a material thickness of 10 mm in the first subregion 41, a material thickness of 8 mm in the second subregion 42 and a material thickness of 6 mm in the third subregion 43.

In the longitudinal joints 44, 45, the subregions of different material thickness butt against one another and are joined together by weld seams extending in the transverse direction. Welded-on reinforcing plates 46, 47 extend across the longitudinal joints 44, 45 and impart additional stability to the longitudinal joints 44, 45.

Figure 5:
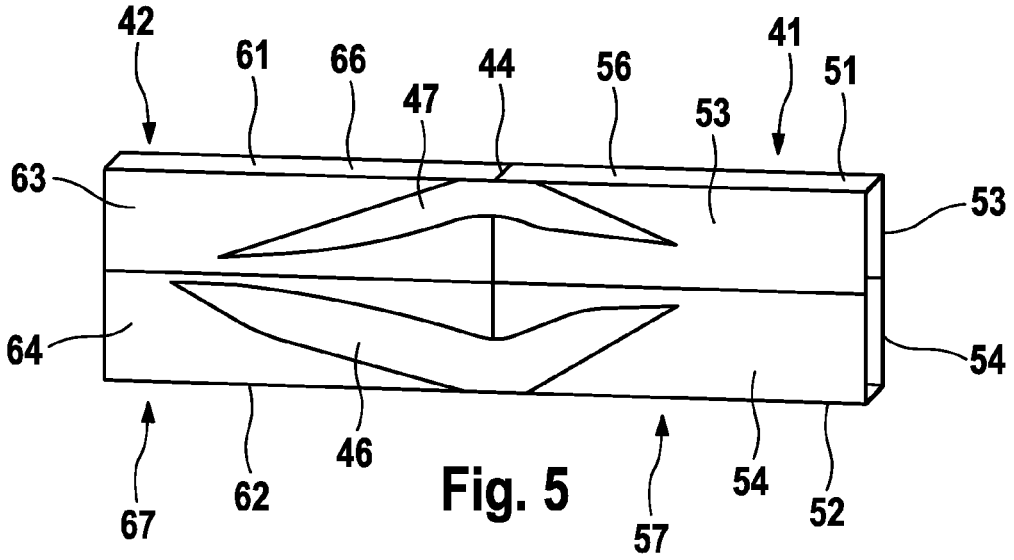
FIG. 5: shows a detail of a boom-arm segment according to the invention.

According to FIG. 5, the box-shaped profile of the boom-arm segment in the first subregion 41 is assembled from two component profiles 51, 52. The component profiles 51, 52 are each produced from 10 mm thick steel sheet. Component profile 51 comprises two side-part portions 53, which are bent over through 90° with respect to a chord portion 56. Component profile 52 comprises two side-part portions 54, which are bent over through 90° with respect to a chord portion 57. At their end faces, the side-part portions 53, 54 are butt jointed by weld seams, with the result that a box-shaped profile of rectangular cross section is formed.

Similarly, the box-shaped profile of the boom-arm segment in the second subregion 42 is assembled from two component profiles 61, 62. The component profiles 61, 62 are each produced from 8 mm thick steel sheet. Component profile 61 comprises two side-part portions 63, which are bent over through 90° with respect to a chord portion 66. Component profile 62 comprises two side-part portions 64, which are bent over through 90° with respect to a chord portion 67. At their end faces, the side-part portions 53, 54 are butt jointed by weld seams, with the result that a box-shaped profile of rectangular cross section is formed.

In the region of the longitudinal joint 44, the box-shaped profile of the first subregion 41 coincides with the box-shaped profile of the second subregion 42, with the result that the two subregions 41, 42 can be joined together by a weld seam running around in the transverse direction.

A reinforcing plate 46 is welded onto the side-part portions 54, 64 from the outside by means of a peripheral weld seam and extends across the longitudinal joint 44. Starting from the region of the longitudinal joint 44, the reinforcing plate 46 tapers toward its two ends. In the region of the longitudinal joint 44, the reinforcing plate 46 extends as far as the edge relative to the chord portion 57, 67. The two ends of the reinforcing plate 46 are at a distance from this edge. A reinforcing plate 47 of similar configuration is welded onto the side-part portions 53, 63 and likewise extends across the longitudinal joint 44.

Figure 6:
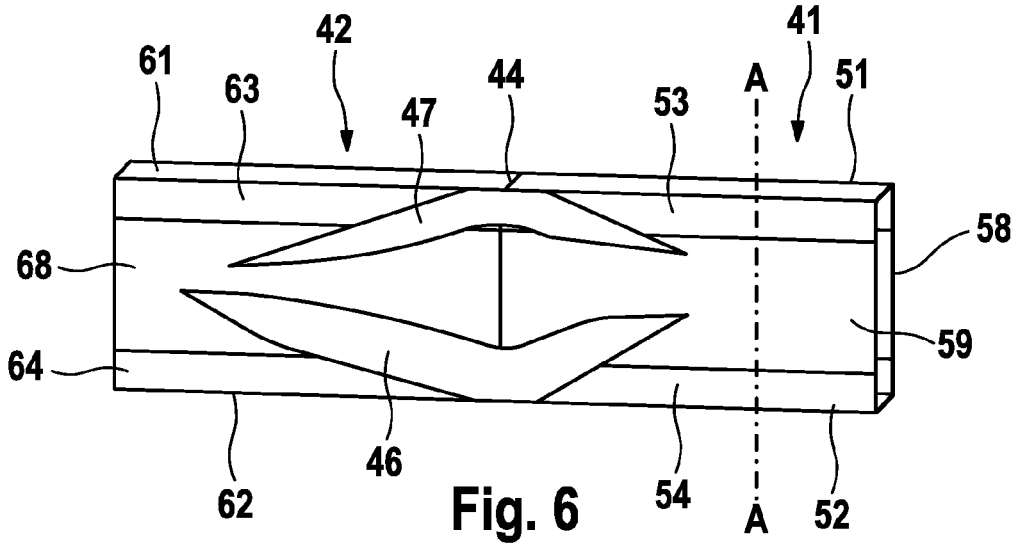
FIG. 6: shows the view according to FIG. 5 in the case of another embodiment of the invention.
Figure 7:
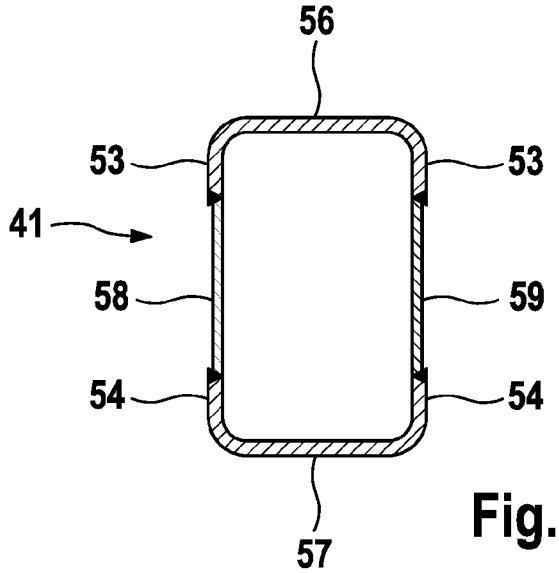
FIG. 7: shows a section along the line A-A through the embodiment according to FIG. 6.

In the alternative embodiment shown in FIGS. 6 and 7, the side-part portions 53, 54 of component profiles 51, 52 as well as the side-part portions 63, 64 of component profiles 61, 62 are significantly shorter. Two side plates 58, 59 are welded in between the side-part portions 53, 54, said plates having a material thickness reduced by 50% compared with the component profiles 51, 52. In the first subregion 41, the side plates 58, 59 accordingly have a thickness of 5 mm. In corresponding fashion, side plates 68 are welded in between the side-part portions 63, 64 in the second subregion 42 of the boom-arm segment. The side plates 68 have a material thickness of 4 mm. The reinforcing plates 46, 47 extend beyond the edge of the side-part portions 53, 54, 63, 64 and also overlap with the side plates 58, 59, 68.

Figure 8:
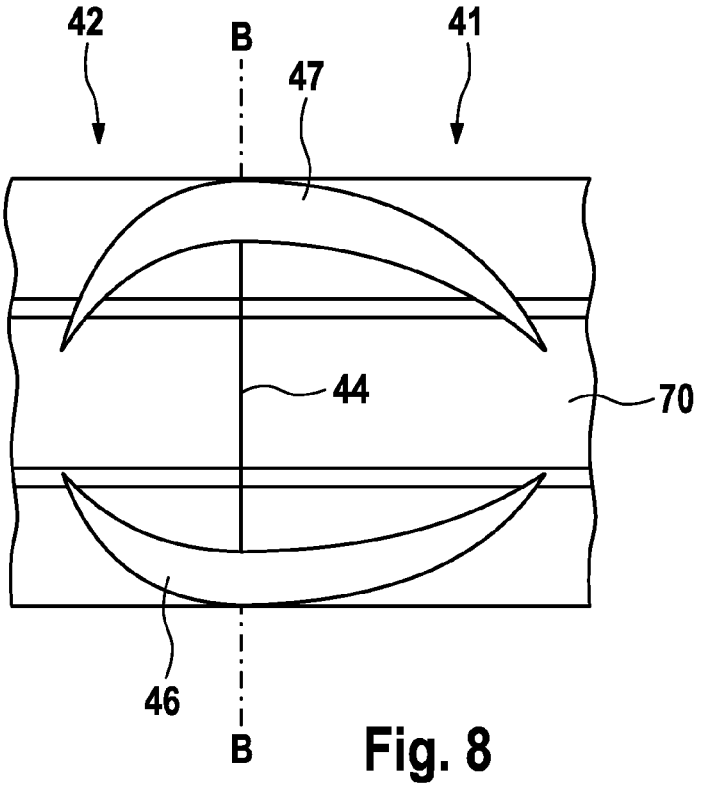
FIG. 8: shows a detail of a boom-arm segment in the case of an alternative embodiment of the invention.
Figure 9:
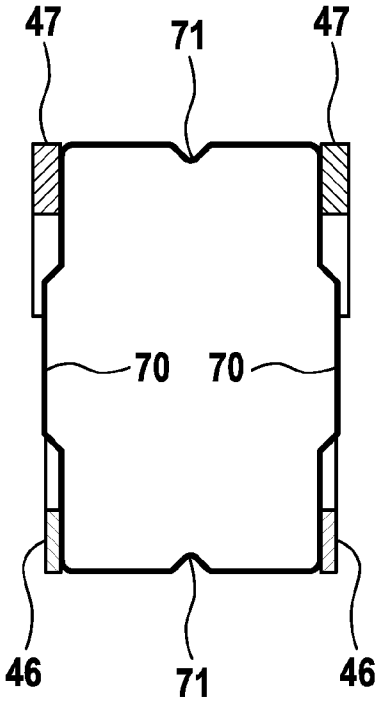
FIG. 9: shows a section along the line B-B in FIG. 8.
Figure 10:
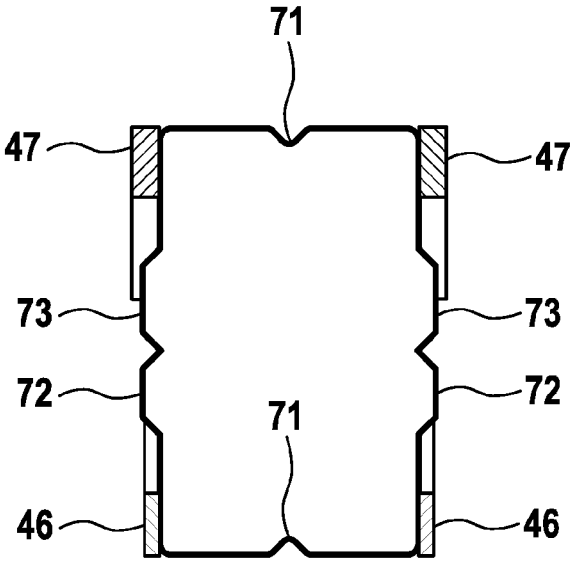
FIG. 10: shows the view according to FIG. 9 in the case of another embodiment of the invention.

In the variant shown in FIGS. 8 and 9, the two side parts of the boom-arm segment are each provided with an outward-projecting bead 70. The two chord surfaces are each provided with an inward-pointing bead 71. The beads 70, 71 impart an increased stability to the profile. The reinforcing plate 47 arranged in the upper region is thicker than the bead 70. In the region in which the reinforcing plate 47 overlaps with the bead 70, the reinforcing plate 47 has a reduced material thickness on its inside, with the result that the outside of the reinforcing plate 47 forms a flat surface. The reinforcing plate 46 arranged in the lower region is thinner than the bead 70 and ends on the sloping surface of the bead 70. In the alternative embodiment shown in FIG. 10, the lateral surfaces are each provided with two beads 72, 73 instead of the single bead 70.

Figure 11:
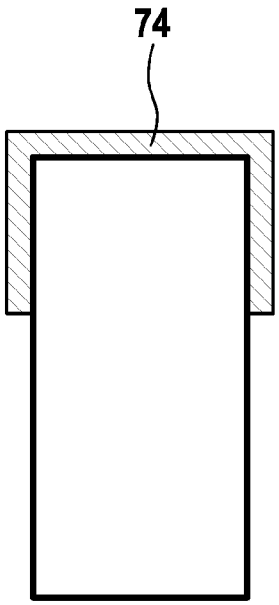
FIG. 11: shows the view according to FIG. 9 in the case of another embodiment of the invention.
Figure 12:
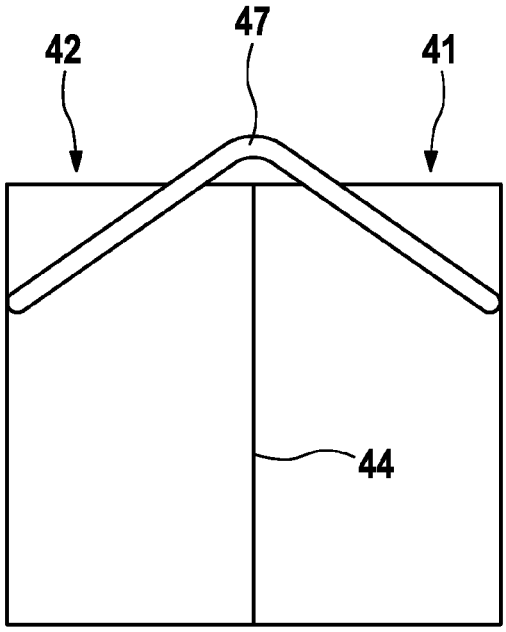
FIG. 12: shows the view according to FIG. 8 in the case of another embodiment of the invention.

In the embodiment shown in FIG. 11 a reinforcing plate 74 extends over the entire width of the boom-arm segment and overlaps with the upper region of the two opposite side parts in the manner of a sleeve. FIG. 12 shows an embodiment in which the reinforcing plate 47 projects upward beyond the contour of the boom-arm segment.

Figure 13:
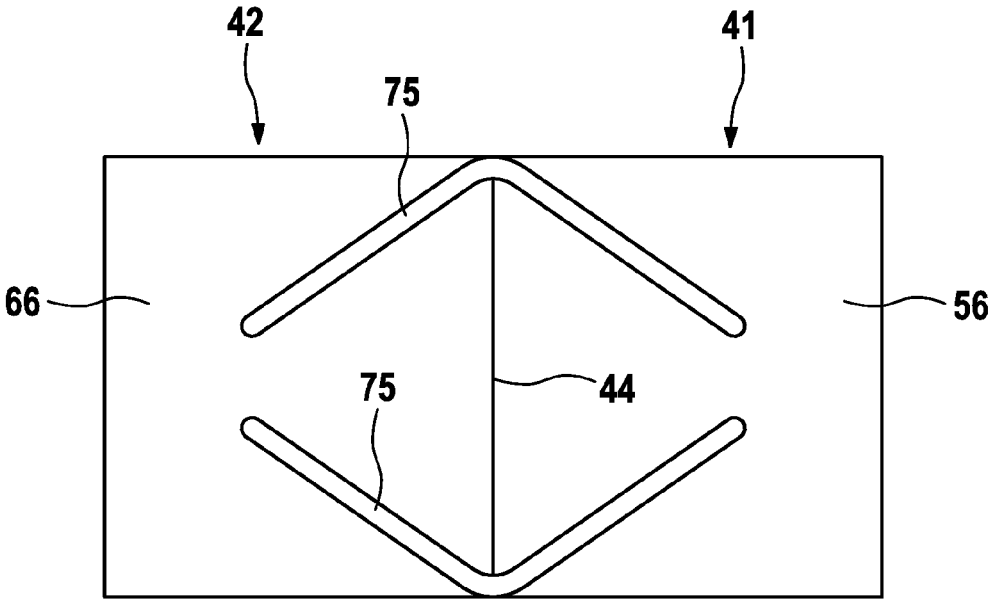
FIG. 13: shows a view of a chord surface of a boom-arm segment according to the invention.

In FIG. 13, two reinforcing plates 75 are arranged on the chord surface and extend across the longitudinal joint 44 between the chord portions 56, 66. The reinforcing plates 75 project upward relative to the chord portions 56, 66, with the result that the extent of the boom-arm segment in the vertical direction is increased by the reinforcing plates 75.

The invention claimed is:

1. A concrete-pump boom-arm segment having an upper chord (33), a lower chord (34) and two side-parts (35, 36), which connect the upper chord (33) and the lower chord (34), and having a longitudinal joint (44) between two subregions (41, 42) of the boom-arm segment which adjoin one another in a longitudinal direction, wherein the longitudinal joint (44) extends over upper chord portions (56, 66) and over first side-part portions (53, 63), wherein the first side-part portions (53, 63) are bent over with respect to the upper chord portions (56, 66) in the first subregion (41) and in the second subregion (42), and wherein a material thickness of the upper chord portion (56) in the first subregion (41) is greater than a material thickness of the upper chord portion (66) in the second subregion (42), and having four reinforcing plates (46, 47), which extend across the same longitudinal joint (44), wherein two of the reinforcing plates (47) overlap with the first side-part portions (53, 63) that are bent over with respect to the upper chord portions (56, 66) and two of the reinforcing plates (46) overlap with second side-part portions (54, 64) which are bent over with respect to lower chord portions (52, 62) of the first and second subregions (41, 42), respectively, each of the four reinforcing plates (46, 47) is arranged close to a respective edge of one of the upper or lower chords (33, 34), and a distance from each reinforcing plate (46, 47) to the respective edge increases with increasing distance from the longitudinal joint.

2. The concrete-pump boom-arm segment of claim 1, wherein the material thickness in the first subregion (41) is between 2 mm and 15 mm.

3. The concrete-pump boom-arm segment of claim 1, wherein the material thickness in the second subregion is less than the material thickness in the first subregion by a value of between 0.5 mm and 4 mm.

4. The concrete-pump boom-arm segment of claim 1, wherein the upper chord portion (56) in the first subregion (41) and the upper chord portion (66) in the second subregion (42) extend in the same plane.

5. The concrete-pump boom-arm segment of claim 1, wherein the longitudinal joint (44) extends over entire widths of the upper chord portions (56, 66).

6. The concrete-pump boom-arm segment of claim 1, wherein the first side-part portions (53, 63) that are bent over with respect to the upper chord portions (56, 66) are connected to the second side-part portions (54, 64) that are bent over with respect to the lower chord portions (52, 62).

7. The concrete-pump boom-arm segment of claim 1, wherein the first side-part portions (53, 63) are connected to respective side plates (58, 59, 68), wherein the side plates (58, 59, 68) have a lower material thickness than a material thickness of the first side-part portions (53, 63).

8. The concrete-pump boom-arm segment of claim 1, wherein the boom-arm segment tapers from the first subregion (41) in the direction of the second subregion (42).

9. The concrete-pump boom-arm segment of claim 1, wherein the reinforcing plates (46, 47) taper with increasing distance from the longitudinal joint (44).

10. The concrete pump boom-arm segment of claim 1, wherein the material thickness in the first subregion (41) is between 3 mm and 10 mm.

11. The concrete pump boom-arm segment of claim 1, wherein the material thickness in the second subregion (42) is less than the material thickness in the first subregion (41) by a value of between 1 mm and 3 mm.

12. A method for producing a concrete-pump boom-arm segment, wherein the boom-arm segment comprises an upper chord (33), a lower chord (34) and two side parts (35, 36), which connect the upper chord (33) and the lower chord (34), wherein a longitudinal joint (44) is produced between a first subregion (41) of the boom-arm segment and a second subregion (42) of the boom-arm segment, which longitudinal joint (44) extends over upper chord portions (56, 66) and over first side-part portions (53, 63) of the first and second subregions (41, 42), wherein the first side-part portions (53, 63) are bent over with respect to the upper chord portions (56, 66) in the first subregion (41) and in the second subregion (42), and wherein a material thickness of the upper chord portion (56) in the first subregion (41) is greater than a material thickness of the upper chord portion (66) in the second subregion (42), and arranging four reinforcing plates (46, 47), which extend across the longitudinal joint (44), wherein two of the reinforcing plates (47) overlap with the first side-part portions (53, 63) that are bent over with respect to the upper chord portions (56, 66) and two of the reinforcing plates (46) overlap with second side part side-part portions (54, 64) which are bent over with respect to lower chord portions (52, 62) of the first and second subregions (41, 42), respectively, each of the four reinforcing plates (46, 47) is arranged close to a respective edge of one of the upper or lower chords (33, 34), and a distance from each reinforcing plate (46, 47) to the respective edge increases with increasing distance from the longitudinal joint.

* * * * *